US005579702A

United States Patent [19]

Aho

[11] Patent Number: 5,579,702

[45] Date of Patent: Dec. 3, 1996

[54] SHELVING CONSTRUCTION

[75] Inventor: A. Stephen Aho, Davison, Mich.

[73] Assignee: Structural Plastics Corporation, Flint, Mich.

[21] Appl. No.: 213,553

[22] Filed: Mar. 16, 1994

[51] Int. Cl.[6] ..... A47B 57/00

[52] U.S. Cl. ..... 108/92; 108/91

[58] Field of Search ..... 108/92, 93, 96, 108/182, 180, 190, 53.1, 53.3, 53.5, 91; 211/194, 188, 186, 190

[56] References Cited

U.S. PATENT DOCUMENTS

| | | | |
|---|---|---|---|
| 3,730,601 | 5/1973 | Misenheimer, III | 108/190 X |
| 4,145,977 | 3/1979 | Yellin | 108/190 |
| 4,467,927 | 8/1984 | Nathan | 108/91 X |
| 4,706,573 | 11/1987 | Sielaff | 108/190 |
| 5,158,187 | 10/1992 | Taub | 108/190 X |
| 5,400,719 | 3/1995 | Santapa et al. | 108/91 X |

FOREIGN PATENT DOCUMENTS

| | | | |
|---|---|---|---|
| 2260076 | 4/1993 | United Kingdom | 108/91 |

*Primary Examiner*—Jose V. Chen
*Attorney, Agent, or Firm*—Learman & McCulloch

[57] ABSTRACT

A shelving construction comprises a plurality of quadrangular panels and a plurality of sets of supporting legs. At least one panel overlies two parallel, spaced apart panels. One set of legs couples the overlying panel to one of the two panels and another set of legs couples the overlying panel to the other of the two panels. The legs interlock the three panels to one another and maintain them securely in their respective positions.

14 Claims, 2 Drawing Sheets

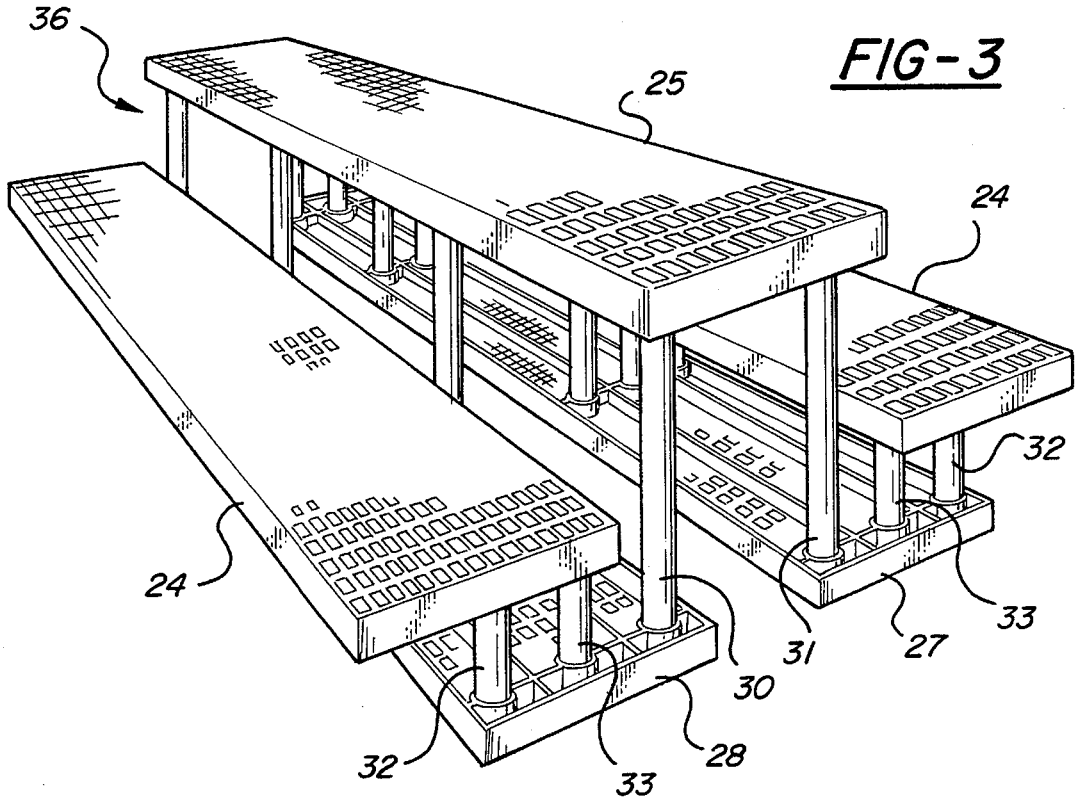
FIG-3
FIG-4
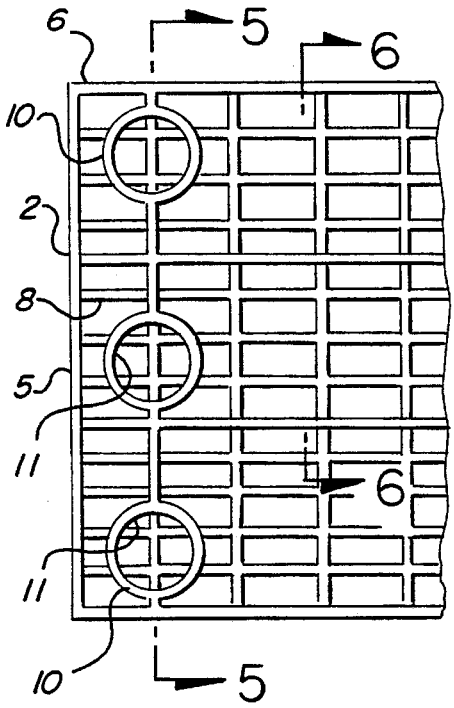
FIG-5
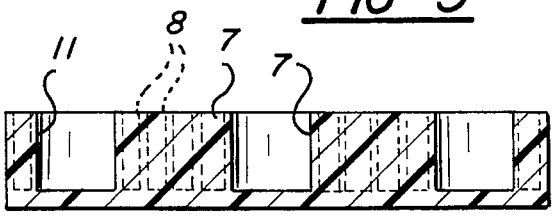
FIG-7
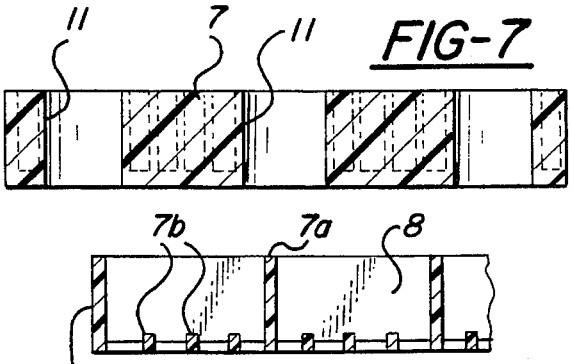
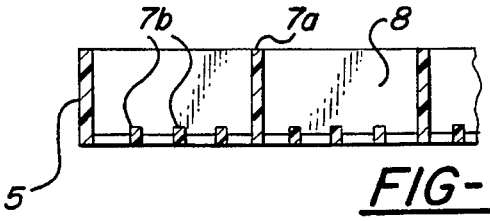
FIG-6

SHELVING CONSTRUCTION

This invention relates to a shelving construction and more particularly to shelving composed of modular, separable panels and supporting legs which enable multiple panels to be supported at the same or different levels and wherein the legs not only provide support for the panels, but also interlock the panels with one another.

BACKGROUND OF THE INVENTION

There are many kinds of shelving constructions which provide display or storage space at multiple levels. Most of the known constructions have spaced apart end frame members which provide support for shelves that span the distance between adjacent frame members. Shelving of this kind is acceptable in those instances in which the location of the shelving unit is relatively permanent and wherein there is little or no need to vary the available shelf space.

Most of the known shelving constructions require assembly from component parts and the parts are of such construction that fasteners and tools are necessary to assemble and maintain the parts in assembled condition.

Most of the currently available shelving constructions that are self-supporting are formed of metal, wood, plastic, and combinations of such materials. Such materials usually require painting or staining, as well as periodic touching up to eliminate unsightly scratches and scrapes.

An object of the present invention is to provide a modular shelving construction which overcomes the disadvantages referred to above.

SUMMARY OF THE INVENTION

Shelving constructed in accordance with the invention comprises a plurality of panels of the same configuration and the same or different size and a plurality of sets of supporting legs of the same or different lengths. Two of the panels function as base panels and may be placed side by side on the ground or other supporting surface in spaced apart, parallel relation. A third panel is positioned at a level above the two base panels so as to parallel them and span the space between them. One set of supporting legs extends from one of the two base panels to the third panel and a second set of supporting legs extends from the third panel to the other of the two base panels. The opposite ends of the legs of each set are accommodated in sockets, thereby securely coupling the third panel to each of the two base panels and interlocking all three panels. One or more additional panels then may be supported by either or both of the two base panels by legs which are either the same or different length, thereby enabling the additional panel or panels to be located at levels that correspond to or are above or below the level of the third panel.

The ends of the supporting legs fit snugly in the sockets formed in the respective panels so as to provide rigid support for the respective panels and securely interlock them with one another. However, the legs easily are removable from the sockets, thereby enabling quick assembly and disassembly of the several parts without the necessity of using any tools or fasteners.

The panels and legs are molded from a plastic material which requires no painting or staining and is virtually impervious to weather and temperature changes. The panels preferably are of grid form and the legs are hollow, thereby providing shelving that is structurally strong but light in weight.

THE DRAWINGS

Shelving constructed in accordance with preferred embodiments of the invention is illustrated in the accompanying drawings, wherein:

FIG. 3 is a perspective view of shelving components assembled in a different manner;

FIG. 4 is a fragmentary, enlarged, bottom plan view of one of the components of the shelving;

FIG. 5 is a sectional view taken on the line 5—5 of FIG. 4;

FIG. 6 is a sectional view taken on the line 6—6 of FIG. 4; and

FIG. 7 is a view similar to FIG. 5, but illustrating a modified embodiment.

THE PREFERRED EMBODIMENTS

Figure 1:
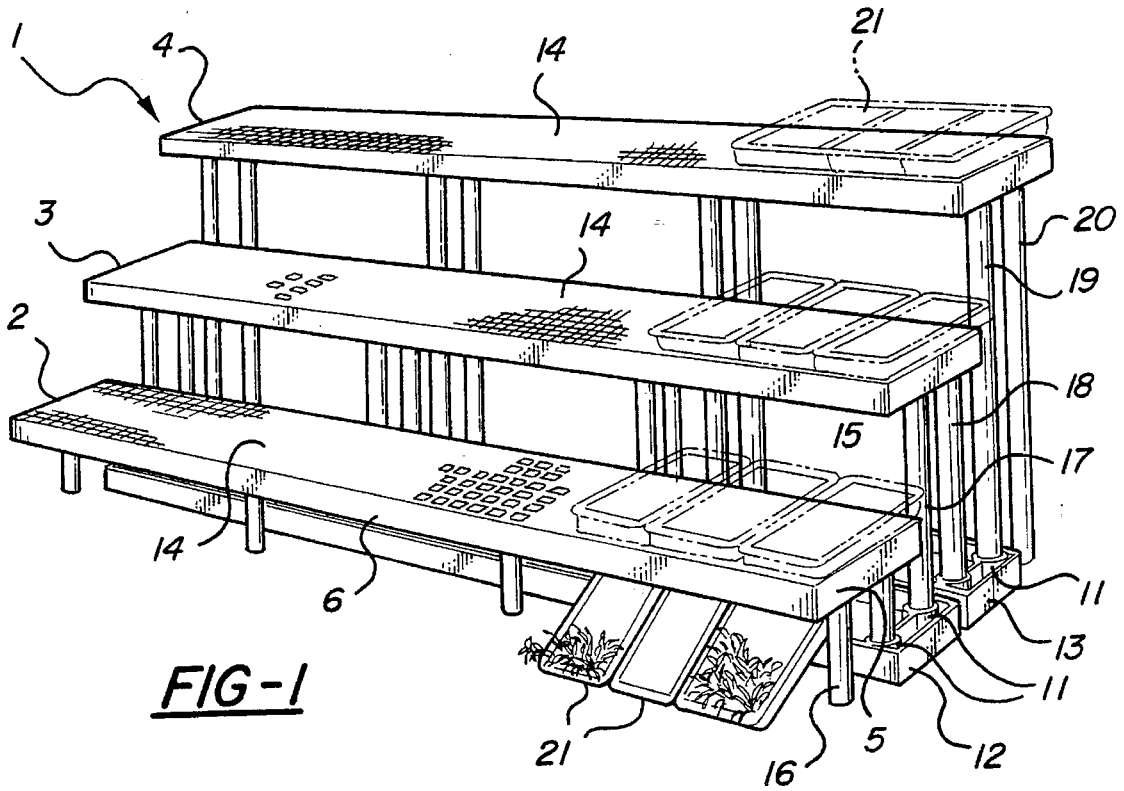
FIG. 1 is a perspective view of shelving components constructed and assembled in accordance with an embodiment.

Shelving constructed in accordance with all of the embodiments of the invention utilize elongate, quadrangular or other geometrically shaped panels and supporting legs. In some instances all of the panels are the same, whereas in others there may be differences in the width of some of the panels. In some of the embodiments the supporting legs are of two different lengths only, whereas in other embodiments there may be legs of several different lengths. In some embodiments the panels have sockets provided with positive stops, whereas in others the sockets are open at both ends. The embodiments disclosed in the drawings incorporate all of these modifications.

The shelving embodiment 1 disclosed in FIG. 1 comprises three elongate, rectangular panels 2, 3, and 4 which are identical in length and width. The panel 2 is shown in detail in FIGS. 4–6 and comprises planar ends 5 and sides 6 joined by longitudinal and transverse ribs 7 and 8, respectively, which are spaced from one another to form an open, grid-like appearance. Some of the longitudinal ribs 7 have a height greater than others, as is shown at *7a* and *7b* in FIG. 6, and the ribs 8 are of uniform or varying height like the ribs *7a*, *7b*. At intervals each panel has a circular wall 10 which forms a socket 11. The sockets which extend longitudinally of the panel are aligned with one another and the sockets which extend transversely of the panel also are aligned with one another. The longitudinal spacing between the longitudinally extending sockets is uniform, and the transverse spacing between the transversely extending sockets is uniform. Thus, each panel 2, 3, and 4 is identical.

In the embodiment shown in FIG. 1 there are two additional panels 12 and 13. These panels correspond to the panels referred to above, except that they are not as wide. In all other respects, however, the panels 12 and 13 are like the earlier described panels. The panels 12 and 13 correspond to one another.

As is shown in FIGS. 4 and 5 the ribs 7 and 8 extend across the sockets at one surface of the panels 2–4, thereby forming positive stops at corresponding ends of the sockets. It is possible, however, to omit the stop-forming ribs, thereby providing sockets which are open at both ends as is shown in FIG. 7.

As is shown in FIG. 1, each of the panels 2–4 has at one side thereof a planar surface 14. Each of the panels 12 and 13 has at one side thereof a similar planar surface. As also is shown in FIG. 1 the planar surfaces 14 of the panels 2–4 face upwardly, whereas the planar surfaces of the panels 12 and 13 face downwardly to present the open ends of the sockets 11 upwardly. Should the panels 12 and 13 have open ended sockets, however, the planar surfaces thereof may face upwardly.

Fitted into or coupled to the sockets 11 of the panel 12 are corresponding ends of a plurality of upstanding, hollow, cylindrical supporting legs 15, the opposite ends of which are fitted into or coupled to correspondingly spaced sockets 11 along one edge of the panel 2. Additional supporting legs 16 have their upper ends accommodated in the correspondingly spaced sockets along the opposite edge of the panel 2. The legs 16 are longer than the legs 15 so as to bear against the floor or other surface on which the panels 12 and 13 are supported.

Two sets of supporting legs 17 and 18 have their upper ends fitted into the sockets of the panel 3. The lower end of each of the legs 17 is fitted into a corresponding one of the sockets of the panel 2 that is not occupied by a leg 15, whereas the lower end of each of the legs 18 is fitted into a correspondingly located socket 11 of the panel 13. Each of the legs 17 and 18 is of uniform length, thereby enabling the upper surface 14 of the panel 3 to be horizontal.

Two additional sets of legs 19 and 20 have their upper ends fitted into the sockets of the panel 4. The lower end of each leg 19 is fitted into the socket of the panel 13 which is not occupied by a leg 18. Each leg 20 is longer than the legs 19 so as to enable the lower end of each of the legs 20 to bear against the ground or other surface on which the panel 13 is supported, thereby enabling the upper surface of the panel 4 also to be horizontal.

The sockets 11 in panels 12 and 13 are closed at one end by the ribs 7 and 8. If these sockets were open at both ends, the legs 15 and 16 may be the same length and the legs 19 and 20 also may be the same length.

In the embodiment disclosed in FIG. 1 the space between the adjacent panels 12 and 13 is spanned by the panel 3, and the sets of legs 17 and 18 interlock the panel 3 with each of the panels 12 and 13, thereby providing a stable support for the panel 3. Since the panels 12 and 13 are interlocked by the panel 3 and the sets of legs 17 and 18, the panels 2 and 4 also are securely maintained in a position in which they parallel each other and the panel 3.

Trays 21, such as plant flats, may be supported on the surfaces 14 of the panels 2–4 and, if desired, additional trays may have their rear ends supported by the panel 12 so that such trays are inclined forwardly and downwardly as is shown in full lines in FIG. 1. A particular advantage of the disclosed construction is that the entire upper surface of each panel 2–4 is unobstructed, thereby enabling the entire surface to be available for the support of the trays.

As is apparent from FIG. 1 the panels 2–4 are arranged in stairstep configuration with the panel 4 overhanging a part of the panel 3 and the latter overhanging a part of the panel 2, but other arrangements are possible, as will be shown.

Figure 2:
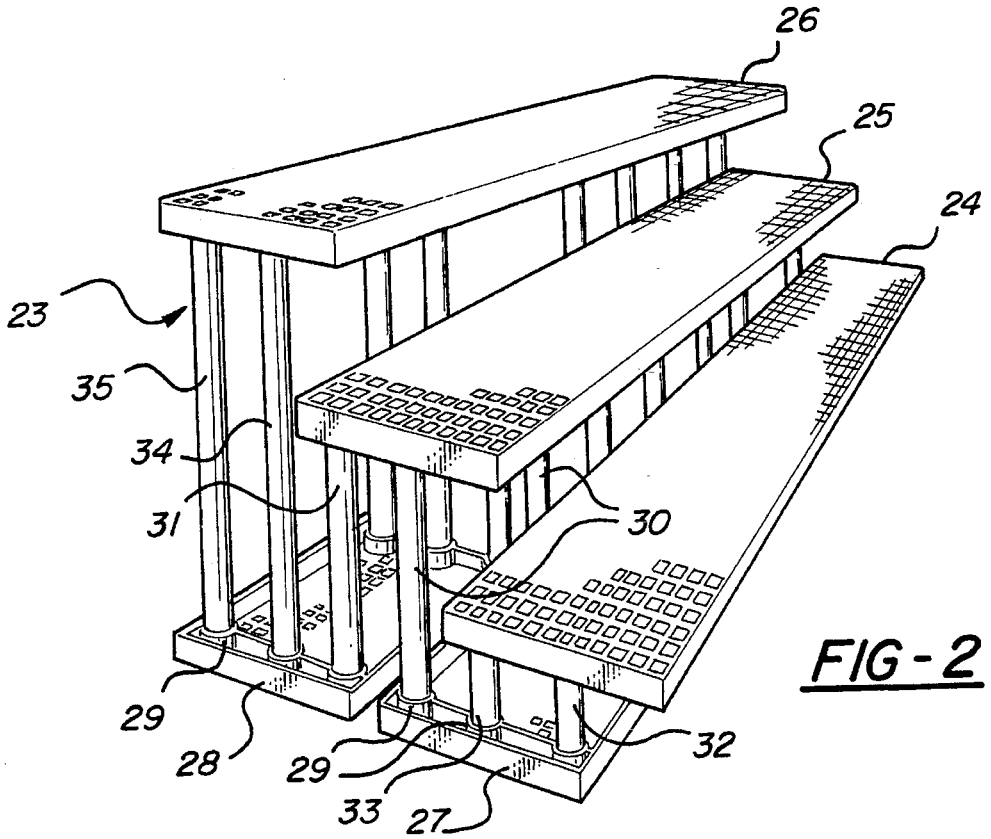
FIG. 2 is a perspective view of shelving components constructed and assembled in accordance with another embodiment.

The shelving construction 23 shown in FIG. 2 is similar to the earlier described embodiment, but differs therefrom in several ways. The shelving construction 23 comprises five panels 24, 25, 26, 27, and 28. Each of the panels 24–28 has a grid construction corresponding to that described earlier and the sockets of each panel are closed at one end by stops. One difference between the panels 24–28 and the earlier described panels is that each of the panels 24–28 has three rows of sockets 29, rather than two, as is the case with the embodiment shown in FIG. 1.

The panels 27, 28 are placed on the ground or other support so that the sockets 29 face upwardly and confront the downwardly facing socket in the panels 24–26. Again, the panels 27, 28 are spaced apart and parallel to each other. Two sets of uniform length supporting legs 30, 31 have their upper ends accommodated in two adjacent rows of the sockets 29, and the upper ends of the legs 30 are accommodated in the adjacent and corresponding sockets of the panel 25. The panel 25 overlies both of the lower panels 27 and 28 and spans the space therebetween. The lower ends of the legs 30 are fitted into the rearmost sockets 29 of the panel 27 and the lower ends of the legs 31 are fitted into the forwardmost sockets of the panel 28. The panel 25, accordingly, is interlocked with each of the lower panels 27 and 28 and occupies a position well above the panels 27, 28.

The panel 24 has two sets of supporting legs 32 and 33 having their upper ends accommodated in correspondingly located sockets in the panel 24 and their lower ends accommodated in the remaining sockets of the panel 27. The legs 32 and 33 are of equal length.

The panel 26 is supported at a level above that of the panel 28 by two sets of uniform length support legs 34 and 35. The upper end of each leg is accommodated in corresponding sockets in the panel 26 and the lower end of each support leg is accommodated in corresponding sockets in the lower panel 28.

In the embodiment shown in FIG. 2 the forward end of the panel 26 is spaced above and overhangs a portion of the panel 25, and the forward end of the panel 25 is spaced above and overhangs a portion of the panel 24. The forward end of the panel 24 projects beyond the lower panel 27.

If the sockets 29 of the lower panels 27 and 28 are open at both ends, as shown in FIG. 7, the flat grid surface of each panel may face upwardly. In this instance the lower ends of the legs 30, 31; 32, 33; and 34, 35 extend completely through the sockets.

The shelving construction 36 shown in FIG. 3 uses the two panels 27 and 28, two of the panels 24, and one of the panels 25. In this embodiment there is one set of legs 30 and 31 and two sets of legs 32, 33. All of the legs 30, 31 are uniform in length, and all of the legs 32, 33 are uniform in length, but shorter than the legs 30, 31. The arrangement of the panels in FIG. 3 differs from that shown in FIG. 2 only in that one panel 24 and its supporting legs 32, 33 is used in lieu of the panel 26 and its supporting legs 34, 35. In all other respects the two embodiments are the same.

In each of the disclosed embodiments it is a simple matter to couple the supporting legs to their respective panels so as to produce a shelving configuration as desired. Since each supporting leg is removably accommodated in two respective sockets, any assembled group of panels and supporting legs may be disassembled simply by separating the panels from the supporting legs. It thus is easy to locate the shelving structure in any desired location.

The panels and supporting legs preferably are formed from plastic material, such as high density polyethylene, which is readily available, tough, and durable. Due to the grid-like construction of the panels and the hollow supporting legs, a shelving structure of considerable capacity may be quite light in weight.

The molding of the panels and legs from plastic material enables the components to be produced in selected colors and, since the color of each component is consistent throughout its thickness, scratches and scrapes do not disfigure the components to the same extent that they would if the components were simply painted or stained.

The disclosed embodiments are representative of presently preferred forms of the invention, but are intended to be illustrative rather than definitive thereof. The invention is defined in the claims.

I claim:

1. A shelving construction comprising a pair of substantially coplanar, parallel, spaced apart base members; first and second shelf members each of which has an upper surface, one of said shelf members overlying one only of said base members and the other of said shelf members overlying both of said base members and spanning the space therebetween; a first set of legs coupled at corresponding ends to one of said base members and at opposite corresponding ends to one of said shelf members for supporting said one of said shelf members at a first level above said base members; and a second set of legs coupled at corresponding ends to the other of said shelf members and at corresponding opposite ends to both of said base members for supporting the other of said shelf members at a second level above said base members, said first set of legs having a length different from that of said second set of legs thereby enabling said shelf members to be supported at different levels above said base members, the entire upper surface of each of said shelf members being wholly unobstructed by any of the legs of said sets of legs.

2. The construction according to claim 1 wherein each of said base members and each of said shelf members has sockets in which said sets of legs are accommodated.

3. The construction according to claim 2 wherein said sockets are uniformly spaced from one another in each of said base members and in each of said shelf members.

4. The construction according to claim 2 wherein each of said sockets is open at one end and closed at its opposite end.

5. The construction according to claim 1 wherein the legs of said first set of legs are uniform in length.

6. The construction according to claim 1 wherein the legs of said second set of legs are uniform in length.

7. A shelving construction comprising a pair of quadrangular, substantially coplanar, parallel base members spaced apart from one another, each of said base members having a upwardly facing surface provided with a plurality of sockets uniformly spaced from one another; a first shelf member corresponding in shape to that of each base member of said pair of base members, said first shelf member overlying a portion of each base member of said pair of base members and spanning the space therebetween, said first shelf member having an upper surface and a lower surface and a plurality of sockets spaced from one another according to the spacing of the sockets in said base members; a second shelf member corresponding in shape to that of said first shelf member and overlying a portion of one only of said base members, said second shelf member having an upper surface and a lower surface and a plurality of sockets corresponding to the spacing of the sockets in said base members; a plurality of legs having corresponding ends accommodated in selected sockets of said first shelf member and corresponding opposite ends accommodated in selected sockets of both of said base members for supporting said first shelf member at a first level above said base members; and a second plurality of legs having corresponding ends accommodated in selected sockets of said second shelf member and corresponding opposite ends accommodated in selected sockets of one of said base members for supporting said second shelf member at a level above said one of said base members, the legs of second plurality of legs being different in length from the legs of the first plurality of legs whereby the levels of said shelf members are different, the entire upper surface of each of said shelf members being wholly unobstructed by any of said legs.

8. The construction according to claim 7 wherein the shelf member at the higher level overhangs a portion of the shelf member at the lower level and is vertically spaced from the upper surface of the shelf member at the lower level.

9. The construction according to claim 7 wherein each of said shelf members is composed of a marginal frame having its edges joined by interconnected ribs.

10. The construction according to claim 7 wherein each of said base members is composed of a marginal frame having its edges joined by interconnected ribs.

11. The construction according to claim 7 wherein each of said shelf members and each of said base members is composed of a marginal frame having its edges joined by interconnected ribs.

12. The construction according to claim 7 wherein each of said shelf members and each of said base members has two parallel rows of said sockets.

13. The construction according to claim 7 wherein each of said base members and each of said shelf members has three parallel rows of said sockets.

14. The construction according to claim 7 wherein all of said base members and all of said shelf members are of the same size and configuration, thereby enabling any of said base members and shelf members to function as a base member or a shelf member.

* * * * *